US008752985B2

(12) United States Patent
Quadri

(10) Patent No.: US 8,752,985 B2
(45) Date of Patent: Jun. 17, 2014

(54) GOBO SUPPORT ASSEMBLY FOR A STAGE LIGHTING FIXTURE, AND STAGE LIGHTING FIXTURE EQUIPPED WITH SUCH A GOBO SUPPORT ASSEMBLY

(75) Inventor: Pasquale Quadri, Torre De' Roveri (IT)

(73) Assignee: Clay Paky S.p.A., Seriate (IT)

( * ) Notice: Subject to any disclaimer, the term of this patent is extended or adjusted under 35 U.S.C. 154(b) by 371 days.

(21) Appl. No.: 12/934,759

(22) PCT Filed: Mar. 25, 2009

(86) PCT No.: PCT/IB2009/000588

§ 371 (c)(1),
(2), (4) Date: Dec. 13, 2010

(87) PCT Pub. No.: WO2009/118608

PCT Pub. Date: Oct. 1, 2009

(65) Prior Publication Data

US 2011/0110099 A1 May 12, 2011

(30) Foreign Application Priority Data

Mar. 27, 2008 (IT) ..... MI2008A0518

(51) Int. Cl.
*F21V 17/02* (2006.01)

(52) U.S. Cl.
USPC ..... 362/322; 362/277; 362/282; 362/283; 362/293; 362/319; 362/324; 362/418; 359/813; 359/814; 359/889; 359/892

(58) Field of Classification Search
USPC ..... 362/277, 278, 282, 319, 321, 322, 418; 359/821, 892
See application file for complete search history.

(56) References Cited

U.S. PATENT DOCUMENTS

| | | | | |
|---|---|---|---|---|
| 5,401,326 | A | 3/1995 | Mihelic | |
| 5,402,326 | A * | 3/1995 | Belliveau | 362/284 |
| 6,601,973 | B2 * | 8/2003 | Rasmussen et al. | 362/282 |
| 7,370,990 | B2 * | 5/2008 | Juřík | 362/227 |
| 8,262,262 | B2 * | 9/2012 | Mahaffey | 362/322 |
| 2002/0075685 | A1 | 6/2002 | Rasmussen | |
| 2009/0323355 | A1 * | 12/2009 | Mahaffey | 362/323 |

FOREIGN PATENT DOCUMENTS

| | | |
|---|---|---|
| WO | WO 2004031825 A1 * | 4/2004 |
| WO | 2004/046607 | 6/2004 |

OTHER PUBLICATIONS

International Search Report and Written Opinion from International Application No. PCT/IB2009/000588.

* cited by examiner

*Primary Examiner* — Robert May
*Assistant Examiner* — Tsion Tumebo
(74) *Attorney, Agent, or Firm* — Dorsey & Whitney LLP

(57) ABSTRACT

A gobo support assembly, for a stage lighting fixture, has a disk-shaped gobo; a gobo support having a first seat for housing the gobo; and a gobo carrier wheel rotating about an axis and having a second seat for housing the gobo support; the gobo carrier wheel and the gobo support being connectable in sliding manner in a direction substantially perpendicular to the axis, and being locked mutually by a reversible click-on locking mechanism to hold the gobo support in a given position inside the second seat.

16 Claims, 4 Drawing Sheets

GOBO SUPPORT ASSEMBLY FOR A STAGE LIGHTING FIXTURE, AND STAGE LIGHTING FIXTURE EQUIPPED WITH SUCH A GOBO SUPPORT ASSEMBLY

CROSS-REFERENCE TO RELATED APPLICATIONS

This application is a U.S. Nationalization of PCT International Application No. PCT/IB2009/000588 filed 25 Mar. 2009, entitled "GOBO SUPPORT ASSEMBLY FOR A STAGE LIGHTING FIXTURE, AND STAGE LIGHTING FIXTURE EQUIPPED WITH SUCH A GOBO SUPPORT ASSEMBLY," which claims priority to Italian Patent Application No. MI2008A000518 filed on 27 Mar. 2008, the contents of both of the foregoing applications are incorporated herein, in their entirety, by this reference.

TECHNICAL FIELD

One or more embodiments of the present invention relate to a gobo support assembly for a stage lighting fixture.

More specifically, the gobo support assembly comprises at least one disk-shaped gobo; at least one gobo support having a first seat for housing a gobo; and a gobo carrier wheel that rotates about an axis and comprises a second seat for housing a gobo support.

BACKGROUND ART

A "gobo" is a metal, normally stainless steel, or glass disk, in which a pattern or shape is formed to produce a light pattern when the gobo intercepts a light beam. Each gobo is normally fitted releasably inside a first seat in a gobo support of the type described in U.S. Pat. No. 5,401,326, and the gobo support is in turn fitted to the gobo carrier wheel, inside a second seat. More specifically, as described in U.S. Pat. No. 5,401,326, each gobo support is riveted to the gobo carrier wheel, so, to change the gobos, they must be extracted axially from the respective supports, which, given the limited amount of space available axially in a lighting fixture, can prove awkward.

To eliminate this drawback, two technical solutions for gobo support assemblies have been proposed, in which the gobo supports are fitted in selectively releasable manner inside the respective second seats on the respective gobo carrier wheels. The two solutions are similar, and are disclosed in Patent Applications US 2002/0075685 and WO 2004/046607 respectively.

In a first solution disclosed in Patent Application US 2002/0075685, the gobo support is inserted at least partly inside the second seat, which is defined by a hole formed in a plate of the gobo carrier wheel; and the gobo support is retained inside the hole by a leaf spring which acts on a gobo support flange resting on one edge of the plate.

A second solution disclosed in Patent Application WO 2004/046607 differs from the first by the gobo support having at least two projections, and by the second seat comprising, in addition to the main hole, two auxiliary holes engaged axially by the projections. In this case, too, the projections are retained inside the respective seats by a leaf spring which acts on a gobo support flange resting on the plate.

Functionally speaking, both the above solutions involve extracting and inserting the gobo supports parallel to the gobo carrier wheel axis, and so require room for manoeuvring.

Using either of the above solutions, the axial space allowed in the stage lighting fixture for the gobo support assembly must therefore equal the axial size of the gobo support assembly plus the manoeuvring space required to insert and extract the gobo supports.

A technical solution that partly solves the problem is described in the 1999 Manual of the Società Coemar S.p.A. CP 1200 Hard Edge stage lighting fixture, available on-line at http.com/Pages/Manual_fix.htm.

Coemar S.p.A. adopted a similar technical solution in their NAT 4000 lighting fixture of 1997, the manual of which can be found on the above web page.

Pages 28 and 29 of the CF 1200 Hard Edge manual describe a gobo support assembly comprising a gobo carrier wheel that rotates about an axis and comprises a plate perpendicular to the axis of rotation, and interchangeable gobo supports. Each gobo support comprises a wedge-shaped flange that fits inside a seat formed inside pins mounted on the base plate; and the gobo support is held in a given position inside the second seat by a spring, which has a first end hinged to the plate, and a second end that hooks onto a projection on the base plate.

Though involving no axial movement to insert and extract the gobo supports, this solution has the drawback of having to detach and reattach the spring whenever a gobo support is extracted and inserted respectively. Moreover, given the axial distance of the gobo support seat, the "axial" size of the gobo support assembly is considerable.

Since the gobo supports are changed entirely by hand by an operator, the tight space available inside the lighting fixture makes it difficult to position the gobo support correctly and to detach and reattach the spring.

DISCLOSURE OF INVENTION

One or more embodiments of the present invention provide a stage lighting fixture gobo support assembly that is axially compact, requires no axial space to insert and extract the gobo supports, and provides for easy change of the gobo supports in general.

According to an embodiment of the present invention, there is provided a gobo support assembly for a stage lighting fixture, the gobo support assembly comprising at least one disk-shaped gobo; at least one gobo support having a first seat for housing a gobo; and a gobo carrier wheel rotating about an axis and comprising at least one second seat for housing a gobo support; the gobo support assembly being characterized in that the gobo carrier wheel and the gobo support are connectable in sliding manner in a direction perpendicular to the axis, and are locked mutually by a reversible click-on locking mechanism to hold the gobo support in a given position inside said second seat.

One or more embodiments of the present invention also relate to a stage lighting fixture.

According to an embodiment of the present invention, there is provided a stage lighting fixture comprising a casing; a light source for generating a light beam; a reflector; and a lens assembly; the stage lighting fixture comprising any of the disclosed gobo support assembly embodiments, and located between the light source and the lens assembly.

BRIEF DESCRIPTION OF THE DRAWINGS

A number of non-limiting embodiments of the invention will be described by way of example with reference to the accompanying drawings, in which.

BEST MODE FOR CARRYING OUT THE INVENTION

Figure 1:
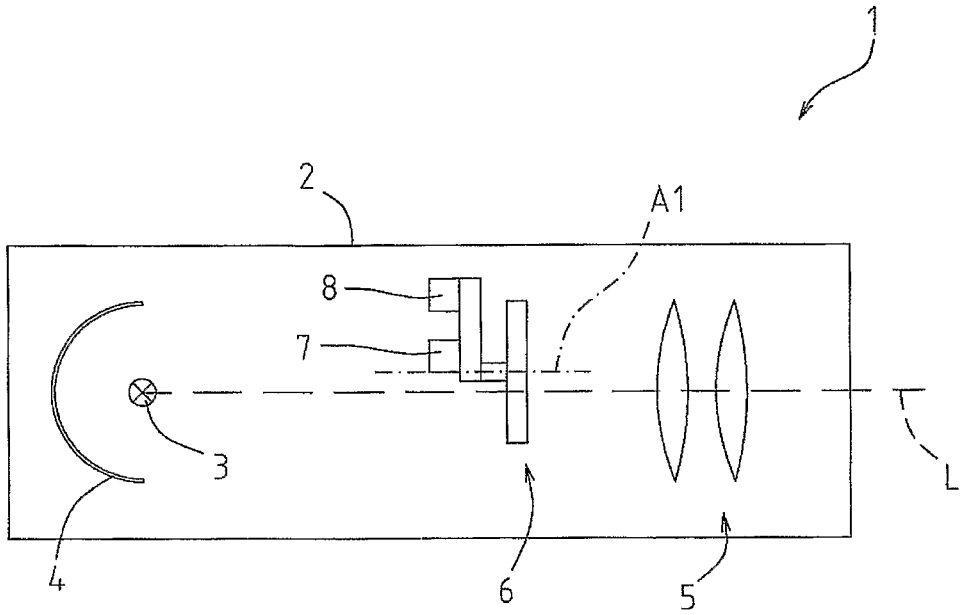
FIG. 1 shows a schematic side view, with parts removed for clarity, of a stage lighting fixture.

Number 1 in FIG. 1 indicates as a whole a stage lighting fixture comprising a casing 2; a light source 3 for generating a light beam L; a reflector 4 for orienting light beam L; and a lens assembly 5 for producing a zoom effect.

The term "stage lighting fixture" comprises both fixed and swivel lighting fixtures.

Lighting fixture 1 normally comprises a number of components (most not shown) located between light source 3 and lens assembly 5 to produce various optical effects, and which include a gobo support assembly 6 for positioning a gobo to intercept light beam L. The other components, such as an effect disk, colour disk, dimmer, frame, and other known equipment (not shown) inside casing 2, take up a considerable amount of room inside lighting fixture 1. In this connection, it is important to bear in mind the market demand for small, easy-to-handle stage lighting fixtures, but featuring numerous component parts for numerous optical effects. Moreover, the stage lighting fixture may comprise a number of gobo support assemblies for greater gobo selection and also combining the optical effects of individual gobos.

Gobo support assembly 6 rotates about an axis A1 substantially parallel to light beam L, is supported on an arm, and is connected by respective transmissions (not shown) to two motors 7 and 8.

Figure 2:
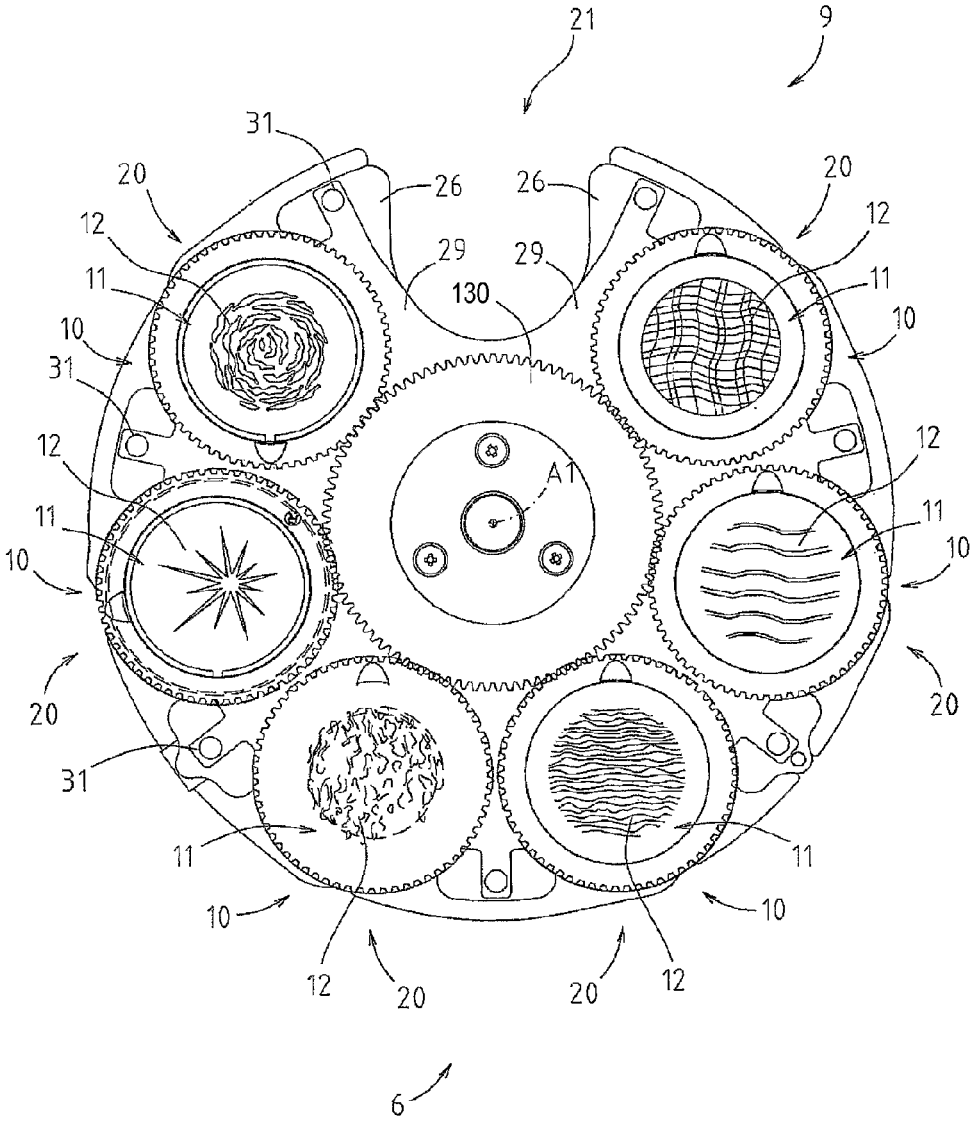
FIG. 2 shows a plan view, with parts removed for clarity, of a gobo support assembly in accordance with an embodiment of the present invention.

With reference to FIG. 2, gobo support assembly 6 comprises a gobo carrier wheel 9 that rotates about axis A1; and a number of—in the example shown, six—gobo supports 10, each having a seat 11 for a respective gobo 12. Gobo support assembly 6, in fact, is an epicyclic gear train, comprising a central gear 130, which acts as a sun gear, rotates about axis A1 independently of gobo carrier wheel 9, and meshes with each gobo support 10, which acts as a planet gear, while gobo carrier wheel 9 acts as a planet carrier.

Gobos 12 in respective gobo supports 10 are interchangeable with gobos 12 of different patterns, and gobo supports 10 can be selectively extracted from and inserted into gobo carrier wheel 9.

Figure 3:
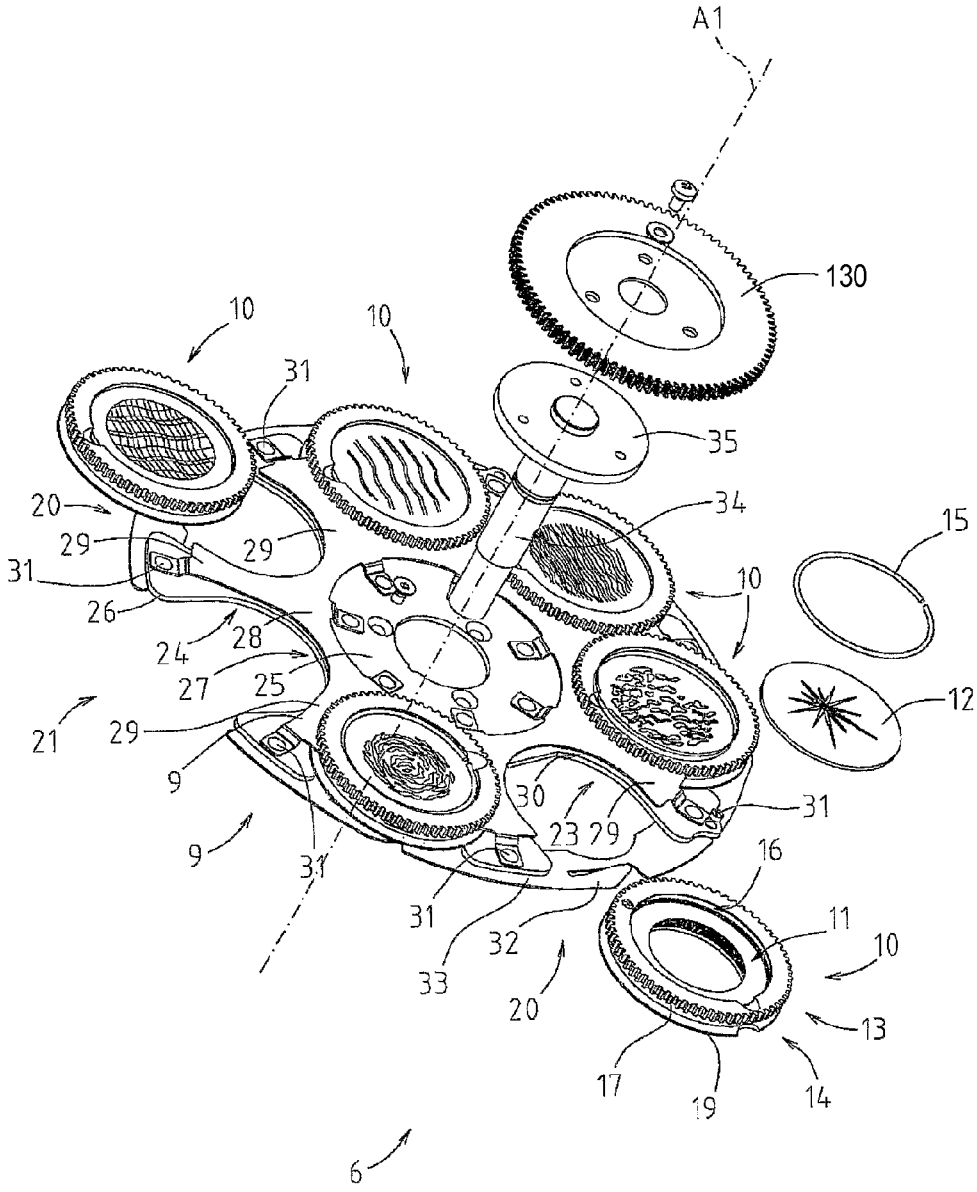
FIG. 3 shows a partly exploded view, with parts removed for clarity, of the FIG. 2 gobo support assembly.

More specifically, and with reference to FIG. 3, each gobo 12 is defined by a metal or glass disk with a pattern in the middle. Each gobo support 10 comprises two rings 13, 14 connected to rotate with respect to each other by means of a bearing not shown. Ring 13 defines the inner seat 11 housing gobo 12, which is held inside seat 11 by a snap ring 15 partly engaging a groove 16 in ring 13; and ring 13 has external teeth 17 that mesh with central gear 130.

Figure 5:
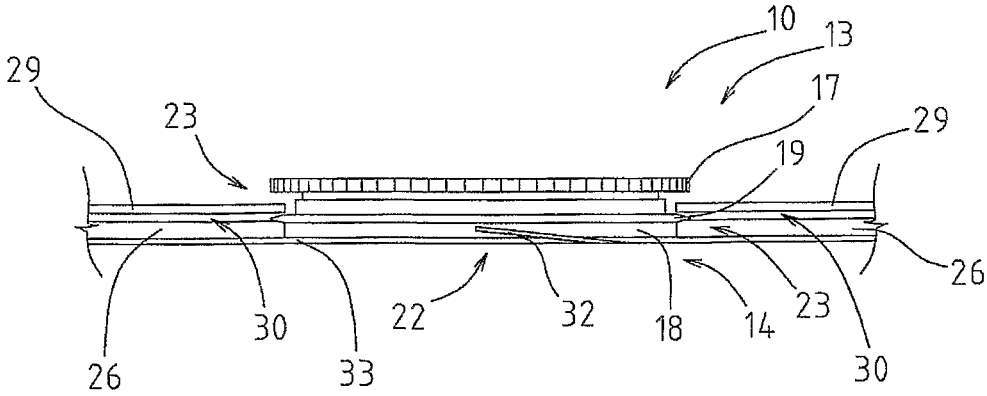
FIG. 5 shows a larger-scale side view, with parts removed for clarity, of the FIG. 2 gobo support assembly.

With reference to FIG. 5, ring 14 comprises an annular body 18; and an annular flange 19 extending radially outwards from annular body 18.

With reference to FIG. 2, gobo carrier wheel 9 comprises a number of seats 20 arranged about axis A1. In the example shown, gobo carrier wheel 9 comprises six seats 20, each for housing a respective gobo support 10; and an opening 21 for free passage of light beam L (FIG. 1).

With reference to FIG. 5, gobo carrier wheel 9 and gobo supports 10 are connectable in sliding manner in a direction perpendicular to axis A1, and are locked mutually by a reversible click-on locking mechanism 22 to hold gobo support 10 in a given position inside seat 20.

More specifically, each seat 20 comprises a guide 23 engaged in sliding manner by gobo support 10.

With reference to FIG. 3, constructionwise, gobo carrier wheel 9 comprises a plate 24 perpendicular to axis A1 and in turn comprising a central body 25, and arms 26 extending substantially radially from central body 25. And each seat 20 is bounded by two arms 26 and central body 25.

Gobo carrier wheel 9 comprises a plate 27 in turn comprising a central body 28, and arms 29 extending substantially radially from central body 28. And each seat 20 is bounded by two arms 29 and central body 28.

In other words, central bodies 25 and 28 and respective arms 26 and 29 define the edges of seats 20.

Plates 24 and 27 are fixed parallel to each other and a given distance apart to define a gap 30 at least along the edge of each seat 20 (FIG. 3); and the two plates 24 and 27 separated by gap 30 define guide 23.

In the example shown, plate 27 comprises spacers 31 riveted to plate 24 and which define gap 30.

As shown more clearly in FIG. 5, annular flange 19 is designed to engage gap 30 in sliding manner with a negligible amount of clearance.

With reference to FIG. 3, reversible click-on locking mechanism 22 comprises a leaf spring 32, which is fixed to plate 24, on the opposite side to plate 27, extends inside the peripheral portion of seat 20, and assumes a lock position when a gobo support 10 is pushed inside seat 20. In the lock position, the free end of leaf spring 32 is located at the angle formed by annular body 18 and annular flange 19 of gobo support 10.

With reference to FIG. 3, the free ends of each two arms 26 are connected by a metal strip 33 on the opposite side to plate 27; and leaf spring 32 extends predominantly circumferentially, and projects axially from metal strip 33 towards plate 27.

Figure 4:
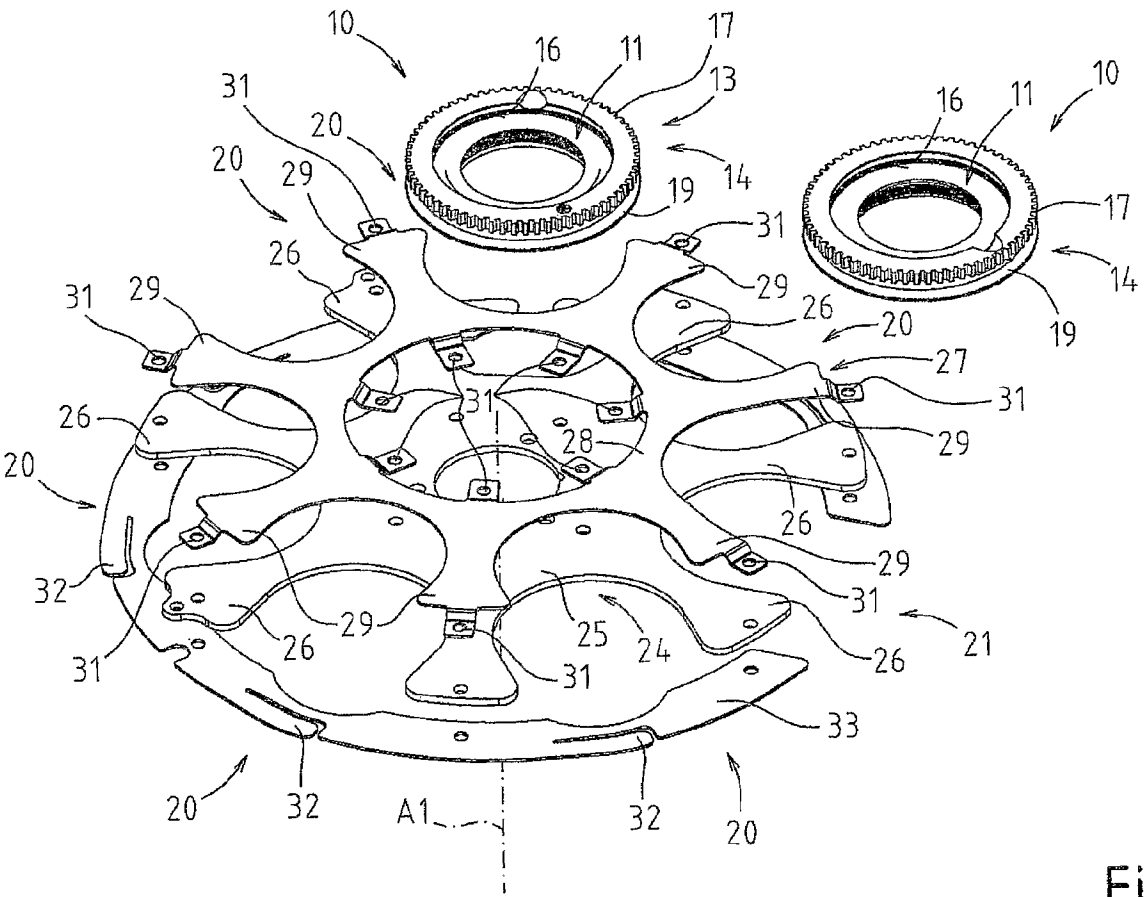
FIG. 4 shows a further exploded view, with parts removed for clarity, of the FIG. 2 gobo support assembly.

In a preferred embodiment, a single C-shaped metal strip 33 connects all of arms 26, as shown more clearly in FIG. 4.

Finally, FIG. 3 shows a shaft 34 which rotates about axis A1; and a flange 35 integral with shaft 34 and which is fixed to central gear 130. Gobo carrier wheel 9 is rotated about axis A1 by motor 7 (FIG. 1) to selectively align a gobo support 10 or opening 21 with light beam L (FIG. 1); and central gear 130 is rotated about axis A1 by motor 8 (FIG. 1) to rotate gobos 12 and produce a mobile lighting effect.

In actual use, gobo support assembly 6 provides for easy extraction of gobo supports 10 and even easier gobo insertion: gobo support 10 is extracted by simply detaching leaf spring 32 from annular flange 19 and simultaneously exerting force radially outwards of gobo carrier wheel 9; and gobo support 10 is inserted inside respective seat 20 by simply placing annular body 18 on leaf spring 32, inserting annular flange 19 inside guide 23 (gap 30 between plates 24 and 27), and pushing gobo support 10 towards axis A1. Once gobo support 10 is seated inside respective seat 20, leaf spring 32 clicks automatically into the angle formed by annular body 18 and annular flange 19.

Clearly, changes may be made to gobo support assembly 6 as described herein without, however, departing from the scope of the accompanying Claims. In particular, the number of seats in gobo carrier wheel 9 may be other than shown, and guide 23 may be formed differently and using different techniques from the one described.

The invention claimed is:

1. A gobo support assembly for a stage lighting fixture, comprising:

at least one disk-shaped gobo;

at least one gobo support having a first seat for housing the at least one disk-shaped gobo; and a gobo carrier wheel rotatable about an axis and comprising at least one second seat for housing the at least one gobo support;

wherein the gobo carrier wheel and the at least one gobo support are connectable in sliding manner in a direction substantially perpendicular to the axis, and are locked mutually by a reversible click-on locking mechanism to hold the at least one gobo support in a given position inside said second seat; and wherein the gobo carrier wheel comprises a first plate substantially perpendicular to the axis, a second plate fixed substantially parallel to the first plate a distance apart from the first plate to define a gap along an edge of each second seat so as to define a radial gap extending along the edge of the at least one second seat and configured to be engaged in sliding manner by the at least one gobo support and the reversible click-on locking mechanism being disposed along an outer circumferential periphery of the gobo carrier wheel and extending predominantly circumferentially and projecting axially towards the second plate to prevent radial displacement of the gobo support.

2. The gobo support assembly as claimed in claim 1, wherein the gobo carrier wheel comprises a number of second seats arranged about the axis; each second seat comprising a guide extending along the edge of the second seat and engaged in sliding manner by the gobo support.

3. The gobo support assembly as claimed in claim 2, wherein said first plate comprises a first central body, and first arms projecting substantially radially from the first central body; the edge of each second seat being bounded by two first arms and the first central body; and said guide extending along the edge of the second seat.

4. The gobo support assembly as claimed in claim 3, wherein said second plate comprises a second central body, and second arms projecting substantially radially from the second central body; the edge of each second seat being bounded by two second arms and the second central body; and the first and second plate being fixed substantially parallel to each other and a distance apart to define said gap along the edge of each second seat.

5. The gobo support assembly as claimed in claim 4, wherein the at least one gobo support comprises a first ring in turn comprising an annular body that is positioned on the first plate, along the edge of the second seat, and an annular flange that projects radially outwards from the annular body to engage said gap in sliding manner.

6. The gobo support assembly as claimed in claim 5, wherein the reversible click-on locking mechanism comprises a leaf spring that is fixed to the first plate, projects inside the peripheral portion of the second seat from a radial edge of the gobo carrier wheel, and assumes a lock position in an angle formed by the annular body and the annular flange.

7. The gobo support assembly as claimed in claim 6, wherein free ends of each of the two first arms on either side of a given second seat are connected to each other across the given second seat by a metal strip disposed radially outward relative to the second plate; said leaf spring projecting from said metal strip inwardly towards the second plate and axis.

8. The gobo support assembly as claimed in claim 5, wherein the at least one gobo support comprises a second ring that is connected in rotary manner to the first ring, defines said first seat, and comprises external teeth; and a gear that is substantially coaxial with the axis, rotates independently with respect to the gobo carrier wheel, and meshes with the teeth of each gobo support.

9. The gobo support assembly as claimed in claim 8, wherein the at least one gobo support comprises a snap ring that fits inside the first seat and inside a respective groove formed in the second ring, inside the first seat.

10. A stage lighting fixture comprising a casing; a light source for generating a light beam; a reflector; and a lens assembly; the stage lighting fixture comprising a gobo support assembly as claimed in claim 1, and located between the light source and the lens assembly.

11. A gobo support assembly for a stage lighting fixture, comprising:

at least one disk-shaped gobo;

at least one gobo support having a first seat for housing the at least one disk-shaped gobo;

a gobo carrier wheel which is configured to rotate about an axis, and includes:

at least one second seat, which includes a radial gap guide extending along an edge of the at least one second seat and is configured to be engaged in sliding manner by the gobo support in a direction substantially perpendicular to the axis; and a reversible click-on locking mechanism, which comprises a leaf spring located at an outer circumferential periphery of the gobo carrier wheel and extending predominantly circumferentially and projecting axially to hold the at least one gobo support in a given position inside the at least one second seat.

12. A gobo support assembly for a stage lighting fixture, comprising:

at least one disk-shaped gobo;

at least one gobo support having a first seat for housing the at least one disk-shaped gobo;

a gobo carrier wheel which is configured to rotate about an axis and comprises:

a first plate substantially perpendicular to the axis;

a second plate fixed substantially parallel to the first plate a distance apart to define a guide;

at least one second seat, which is formed in the first and second plate and includes a guide extending along an edge of the second seat and is configured to be engaged in sliding manner by the gobo support in a direction substantially perpendicular to the axis; and a reversible click-on locking mechanism, which comprises a leaf spring located at an outer circumferential periphery of the gobo carrier wheel and extending predominantly circumferentially and projecting axially towards the second plate to prevent radial displacement of the gobo support.

13. A gobo support assembly for a stage lighting fixture, comprising:

at least one disk-shaped gobo;

at least one gobo support having a first seat for housing the at least one disk-shaped gobo; and a gobo carrier wheel rotatable about a central axis and comprising at least one second seat for housing the at least one gobo support;

wherein the gobo carrier wheel and the at least one gobo support are connectable in sliding manner in a direction substantially perpendicular to the axis, and are locked mutually by a reversible click-on locking mechanism disposed along an outer circumferential periphery of the gobo carrier wheel and extending predominantly circumferentially and projecting axially to hold the at least one gobo support in a given position inside said second seat; and wherein the at least one second seat includes a guide recess extending along an edge of the at least one second seat and configured to be engaged in sliding manner by the at least one gobo support.

14. The gobo support assembly as claimed in claim 1, wherein the at least one gobo support remains substantially perpendicular to the axis during an entire insertion or removal motion as the at least one gobo support is inserted into the gobo carrier wheel.

15. The gobo support assembly as claimed in claim 11, wherein the at least one gobo support remains substantially perpendicular to the axis during an entire insertion or removal motion as the at least one gobo support is inserted into the gobo carrier wheel.

16. The gobo support assembly as claimed in claim 12, wherein the at least one gobo support remains substantially perpendicular to the axis during an entire insertion or removal motion as the at least one gobo support is inserted into the gobo carrier wheel.

* * * * *